US007155763B2

(12) United States Patent
North

(10) Patent No.: US 7,155,763 B2
(45) Date of Patent: Jan. 2, 2007

(54) HAIR AND SCALP PROTECTED BABY LINEN

(76) Inventor: Toya J. North, 118 Canterbury Dr., Carrollton, GA (US) 30117

( * ) Notice: Subject to any disclaimer, the term of this patent is extended or adjusted under 35 U.S.C. 154(b) by 484 days.

(21) Appl. No.: 10/392,013

(22) Filed: Mar. 18, 2003

(65) Prior Publication Data

US 2003/0172461 A1 Sep. 18, 2003

Related U.S. Application Data

(60) Provisional application No. 60/365,108, filed on Mar. 18, 2002.

(51) Int. Cl.
*A47G 9/02* (2006.01)

(52) U.S. Cl. ..... 5/482; 5/486; 5/497; 5/502; 5/926

(58) Field of Classification Search ..... 5/482, 5/486, 495, 497, 498, 499, 502, 926
See application file for complete search history.

(56) References Cited

U.S. PATENT DOCUMENTS 3,423,774 A * 1/1969 Streetman ..... 5/490
3,849,813 A * 11/1974 Neilson ..... 5/495
4,440,817 A * 4/1984 Ahlm ..... 428/71
4,706,314 A * 11/1987 Grant ..... 5/490
4,989,285 A * 2/1991 Troncone et al. ..... 5/482

* cited by examiner

*Primary Examiner*—Alexander Grosz

(57) ABSTRACT

A baby linen including a hair protection layer and an underlying fabric layer. The baby linen may take the form of a baby blanket or a crib sheet. The crib sheet also may be a single layer of material including two sections of material sewn together. The first section of material may include a hair protection material.

14 Claims, 3 Drawing Sheets

HAIR AND SCALP PROTECTED BABY LINEN

RELATED APPLICATIONS

The present application claims priority to Provisional Application Ser. No. 60/365,108, filed on Mar. 18, 2002.

TECHNICAL FIELD

This invention relates to linens. More particularly, this invention relates to baby linens including a hair protection layer that minimizes hair loss and scalp irritation from friction as compared to traditional baby blanket and crib sheet materials.

BACKGROUND OF THE INVENTION

During the early stages of life, infants spend a considerable amount of time sleeping. When lying on the back or side position as recommended by the American Academy of Pediatrics, the baby's hair and scalp may become dry. Movement of the head against cotton sheets then may cause hair breakage. This is particularly true because cotton can be quite abrasive to the hair and scalp.

There is a desire, therefore, for a baby blanket or other device that minimizes the friction between an infant or toddler's head and the blanket. Such a device may minimize the baby's discomfort. More importantly, mothers may feel more comfortable with such a device. The device also should be economical, simple, easy to use, machine washable, durable, and aesthetically pleasing.

SUMMARY OF THE INVENTION

The present invention provides a baby linen for protecting a baby's head and scalp from irritation. The baby linen includes a hair protection layer and an underlying fabric layer. The hair protection layer may be attached to the underlying fabric layer. The hair protection layer also may be made of charmeuse and the underlying fabric layer may include a plurality of fabric layers which could be made from cotton, polyester, or a cotton/polyester blend. The underlying fabric layer also may include at least one layer of batting.

The hair protection layer also may be sewn to the underlying fabric layer to make the baby linen. A plurality of ties may be attached to the baby linen to secure the baby linen to a baby device. In other embodiments, the underlying fabric layer may be fitted or may include elastic to create a snug fit about a crib mattress.

The hair protection layer also may be lesser in size than the underlying fabric layer, and the hair protection layer also may be positioned substantially on one half of the underlying fabric layer.

The present invention may also include a method for protecting a baby's scalp. The method may include the steps of attaching a hair protection layer to an underlying fabric layer, attaching an underlying fabric layer to a crib mattress, and placing the baby's scalp on the hair protection layer.

Yet another embodiment of the present invention may include a crib sheet made of a first section of hair protection material attached to a second section of material. The first section of the hair protection material may be made from charmeuse. The second section of material may be made from cotton, polyester, or a cotton/polyester blend.

The crib sheet may be formed by sewing the first section of material to the second section of material. The first section of material may be equal or lesser in size than the second section of material. The crib sheet also may be fitted or include elastic to create a snug fit about a crib mattress.

Other features of the present invention will become apparent upon review of the following detailed description of the embodiments when taken in conjunction with the drawings and the appended claims.

DETAILED DESCRIPTION OF DRAWINGS

The present invention provides baby linens that are designed to protect an infant's or toddler's scalp and head from abrasive surfaces such as traditional cotton sheets or other bedding. For the purposes of this invention, the term baby linen may include a baby blanket or a crib sheet as described below.

Figure 1:
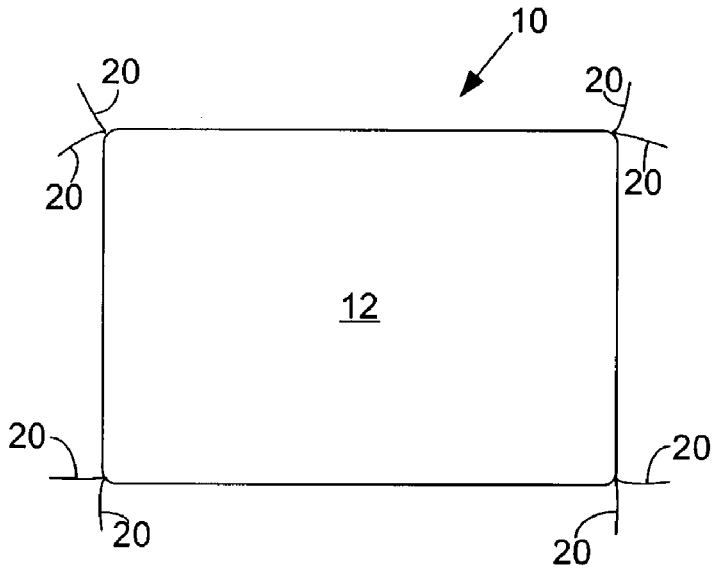
FIG. 1 is a top plan view of a baby blanket of the present invention.
Figure 2:
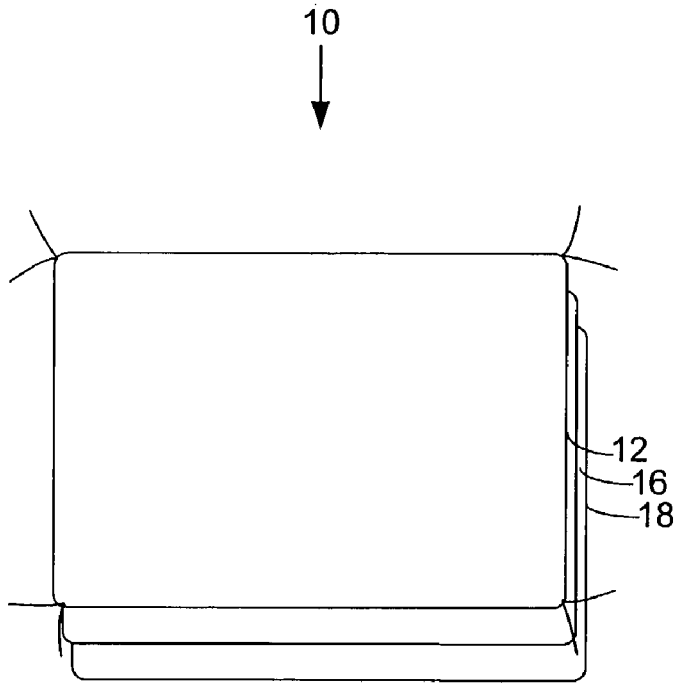
FIG. 2 is an assembly view of the layers in a baby blanket of the present invention.

Referring now in more detail to the drawings, in which like numerals refer to like parts throughout the several views, FIGS. 1 and 2 illustrate a baby blanket 10 that is an embodiment of this invention. Although the blanket 10 is shown as being rectangularly-shaped, the blanket 10 may have any desired shape. For example, the baby blanket 10 also may be squarely shaped, circularly shaped, or any other shape that may be used for a baby blanket. In the present embodiment, the baby blanket 10 may have dimensions of about 25.5 inches long by about 18 inches wide, but any size baby blanket 10 is contemplated.

The blanket 10 may include a top hair protection layer 12. The hair protection layer 12 may be made of satin, charmeuse, or any other nonabrasive material and may be used to reduce friction between an infant or toddler's head and a traditional baby blanket or a crib sheet.

A number of underlying fabric layers may be attached to the hair protection layer 12. The underlying fabric layers may include a batting layer 16 and a bottom layer 18. Further, the underlying layers 16, 18 may be made of any material, such as cotton, polyester, or a material blend such as a cotton/polyester blend, to form the baby blanket 10. Any number of layers may be used.

The hair protection layer 12 and the underlying layers 16, 18 may be sewn together in this respective order to form the baby blanket 10. Adhesives or other types of attachment means also may be used. It is contemplated that the hair protection layer 12 also may be attached or sewn to any number of the underlying layers. The hair protection layer 12 may be of equal or lesser size than the underlying layers 16, 18.

A number of ties 20 or other types of restraining devices may be sewn to the corners of the baby blanket 10. The ties 20 may be used to attach and secure the baby blanket 10 to a crib or to any other equipment used to hold the baby blanket 10. The baby blanket 10 also may be used without the ties 20 as well. The ties 20 may be cloth or strings. Other types of ties 20, such a hook and loop fasteners, also may be used.

The baby blanket 10 of the present invention also may be adapted to other types of baby devices such as baby equipment and furniture. For example, the present invention may be used with bouncer seat covers, bobby cushions, and any other surface that comes in contact with an infant or a toddler's hair or scalp.

Figure 3:
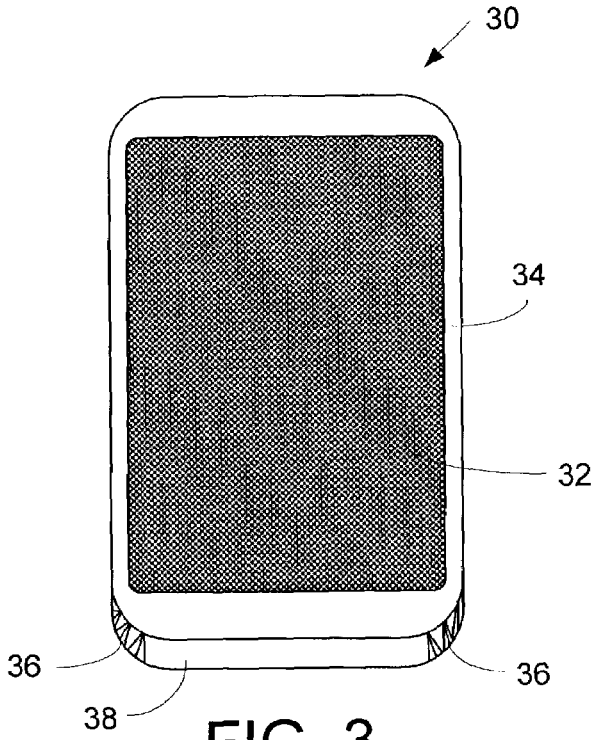
FIG. 3 is a prospective view of a crib sheet of the present invention with a full hair protection layer.

As illustrated in FIG. 3, another embodiment of the present invention may provide a crib sheet 30 that is used to protect a baby's head and scalp. The crib sheet 30 may have any size or shape. The crib sheet 30 may include a top hair protection layer 32. The hair protection layer 32 may be made of charmeuse, satin, silk, polyester, or any other material that reduces friction between an infant or toddler's head and a traditional crib sheet material.

The crib sheet 30 may be made by attaching the hair protection layer 32 to one or more underlying layers of fabric 34. The underlying layers 34 may be fitted or have elastic so that they fit snugly on a standard or nonstandard baby crib mattress 38. The underlying layers may be made of cotton, polyester, cotton/polyester blend, or any other suitable material known to one of ordinary skill in the art.

Figure 4:
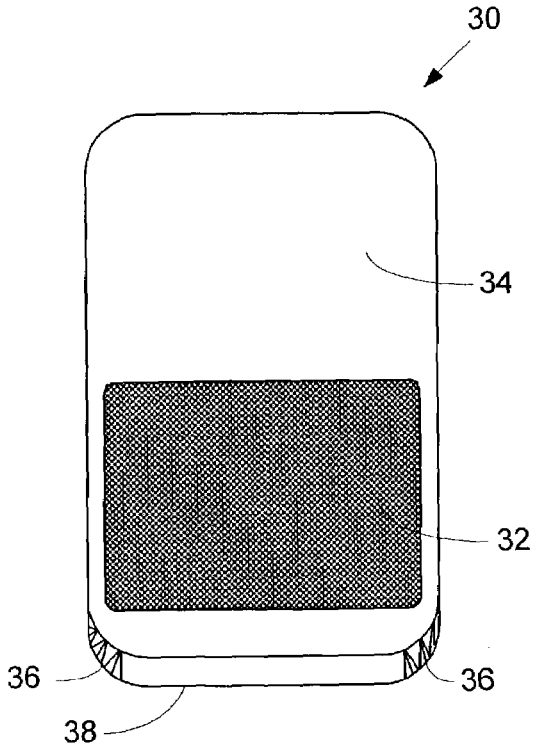
FIG. 4 is a prospective view of a crib sheet of the present invention with a partial hair protection layer.

The hair protection layer 32 may be attached to the underlying layers of fabric 34 by sewing, using adhesives, or by any other attachment method known in the art. The hair protection layer 32 may be of equal or lesser size than the underlying layers 34. Further, the hair protection layer 32 may be substantially less than the size of the underlying layers to save costs. For instance, FIG. 4 illustrates the hair protection layer 32 only being approximately half the size of the underlying layer 34 and being positioned only on the right or left half of the sheet. The baby's head may be placed on top of the hair protection layer 32 and other portions of the baby's body that do not require protection from abrasion may be placed on the underlying layers 34. The hair protection layer 32 also may be less than half the size of the underlying layer 34 and may be any shape that can protect the baby's hair and scalp from abrasion. Shapes may include rectangularly shaped, circularly shaped, or any other adequately shaped arrangement.

Figure 5:
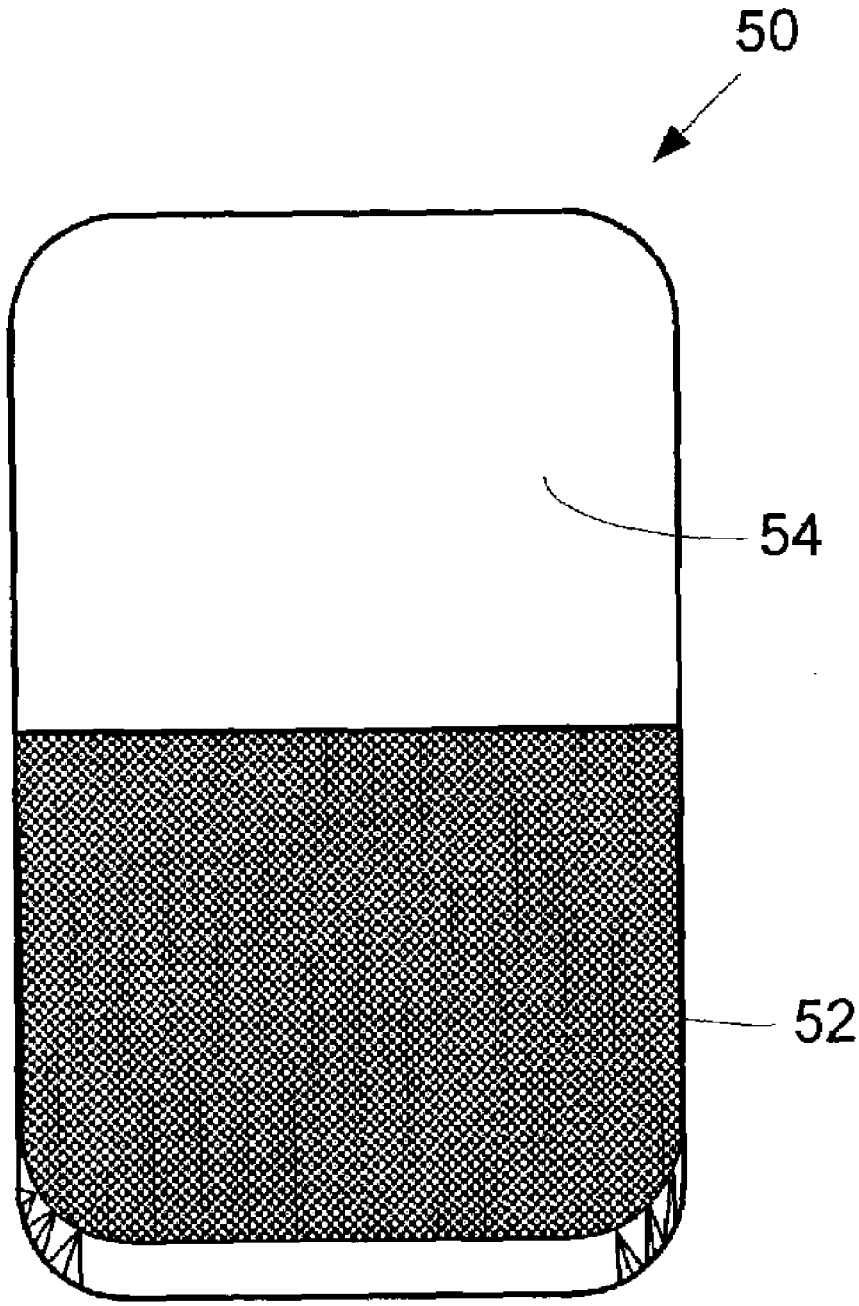
FIG. 5 is a prospective view of a crib sheet of the present invention with a single layer of material made from two sections of material.

As shown in FIG. 5, a crib sheet 50 also may include only a single layer of material. The single layer may include a plurality of materials that are attached together. The single layer may include two sections with different materials. The first section 52 may be made of a hair protection material such as charmeuse, satin, silk, or any other nonabrasive material that would protect the baby's head from friction. The second section 54 may be made of cotton, polyester, cotton/polyester blend, or any other material that is appropriate for operating as a crib sheet. The first section of material 52 may be sewn to the second section of material 54. However, any type of attachment means known in the art is contemplated.

The first section of material 52 and the second section of material 54 may be of equal size so that the first half of the crib sheet 50 is a first material and the second half of the crib sheet 50 is a second material. To save costs, the first section 52 containing the hair protection material may be smaller than the second section of material 54. It is further contemplated that the first section of material 52 is substantially smaller than the second section of material 54 so that at least the head area of the baby is protected. However, if more hair protection material is desired, the first section 52 containing the hair protection material may be larger than the second section of material 54. The first section of material 52 also may be any shape that can protect the baby's hair and scalp from abrasion. Shapes may include rectangularly shaped, circularly shaped, or any other adequately shaped arrangement. The first section of material 52 and second section of material 54 of the crib sheet may be fitted or have elastic so that the crib sheet fits snugly on a standard or nonstandard baby crib mattress.

It should be apparent that the foregoing relates only to the preferred embodiments of the present invention and that numerous changes and modifications may be made herein without departing from the spirit and scope of the invention as defined by the following claims and the equivalents thereof.

I claim:

1. A baby linen, comprising:

an underlying fabric layer; and a hair protection layer attached to the underlying fabric layer, wherein the hair protection layer is substantially smaller than the underlying fabric layer and positioned substantially on one half of the underlying fabric layer to receive a head of a child placed on the baby blanket; and wherein the hair protection layer comprises a nonabrasive material that is more slippery than the underlying fabric layer, to thereby reduce friction between the head of the child and the hair protection layer.

2. The baby linen as in claim 1, wherein said hair protection layer comprises charmeuse.

3. The baby linen as in claim 1, wherein said underlying fabric layer comprises a plurality of fabric layers.

4. The baby linen as in claim 3, wherein said underlying fabric layer comprises at least one layer of batting.

5. The baby linen as in claim 1, wherein said underlying fabric layer comprises a material selected from a group consisting of cotton, polyester, and cotton/polyester blend.

6. The baby linen as in claim 1, wherein said hair protection layer is sewn to said underlying fabric layer.

7. The baby linen as in claim 1, wherein a plurality of ties are attached to said baby linen.

8. The baby linen as in claim 1, wherein said underlying fabric layer is fitted to create a snug fit about a crib mattress.

9. The baby linen as in claim 1, wherein said underlying fabric layer comprises an elastic, wherein said elastic creates a snug fit about a crib mattress.

10. A crib sheet, comprising:

an underlying fabric layer;

a hair protection layer attached to the underlying fabric layer, wherein the hair protection layer is substantially smaller than the underlying fabric layer and positioned substantially on one half of the underlying fabric layer to receive a head of a child placed on the crib sheet;

wherein the hair protection layer comprises a nonabrasive material that is more slippery than the underlying fabric layer, to thereby reduce friction between the head of the child and the hair protection layer; and wherein underlying fabric layer is fitted to create a snug fit about a crib mattress.

11. The crib sheet as in claim 10, wherein said hair protection layer comprises charmeuse.

12. The crib sheet as in claim 10, wherein said underlying fabric layer comprises a material selected from a group consisting of cotton, polyester, and cotton/polyester blend.

13. The crib sheet as in claim 10, wherein said hair protection layer is sewn to said underlying fabric layer.

14. The crib sheet as in claim 10, wherein said underlying fabric layer comprises an elastic, wherein said elastic creates a snug fit about the crib mattress.

* * * * *